United States Patent [19]

Lin

[11] Patent Number: 5,040,391

[45] **Date of Patent: * Aug. 20, 1991**

[54] STRUCTURE FOR CONTROLLING THE DEAD BOLT USED IN AN ELECTRONIC LOCK

[75] Inventor: Jui C. Lin, Kaohsiung, Taiwan

[73] Assignee: Taiwan Fu Hsing Industry Co., Ltd., KangShan, Taiwan

[ * ] The portion of the term of this patent subsequent to Apr. 30, 2008, has been disclaimed.

[21] Appl. No.: 563,610

[22] Filed: Aug. 7, 1990

[51] Int. Cl.[5] ..... E05B 47/00

[52] U.S. Cl. ..... 70/277; 70/279; 70/472

[58] Field of Search ..... 70/107, 277-279, 70/280-282, 224, 472; 340/825.3

[56] References Cited

U.S. PATENT DOCUMENTS

| | | | |
|---|---|---|---|
| 1,834,223 | 12/1931 | Rymer | 70/472 |
| 2,662,387 | 12/1953 | Hagstrom | 70/472 |
| 3,894,417 | 7/1975 | Taniyama | 70/277 X |
| 4,672,829 | 6/1987 | Gater et al. | 70/472 |
| 4,820,330 | 4/1989 | Lin | 70/277 |
| 4,956,984 | 9/1990 | Chi-Cheng | 70/279 X |

*Primary Examiner*—Robert L. Wolfe
*Assistant Examiner*—Suzanne L. Dino
*Attorney, Agent, or Firm*—Fleit, Jacobson, Cohn, Price, Holman & Stern

[57] ABSTRACT

A structure for controlling the dead bolt used in an electronic lock comprising a turning button at the inside of a door for locking or unlocking the lock and a structure at the outside of a door to unlock either with a coded number card or a key.

13 Claims, 4 Drawing Sheets

STRUCTURE FOR CONTROLLING THE DEAD BOLT USED IN AN ELECTRONIC LOCK

BACKGROUND OF THE INVENTION

This invention has an object to improve U.S. Pat. No. 4,820,330 and U.S. Pat. Application Ser. No. 07/469,017, U.S. Pat. No. 5,010,752 having the same title as this invention, supplying an electronic lock having wider adaptability by unlocking not only with a coded number card but also with a key.

SUMMARY OF THE INVENTION

The structure for controlling the dead bolt used in an electronic lock in the present invention comprises an outside cover having two shaft posts for anchoring said outside cover on the outside surface of a door. The outside cover has a shaft hole for an outer actuating tube to fit and rotate therein. The outer actuating tube is assembled and moves together with an outside knob, which has a key hole block holder supporting a key hole block to be inserted in and rotated by a key. The key hole block has a rectangular hole at its bottom end for two feet of a bended plate to fit in such that the bended plate can be rotated by the key hole block. The feet of the bended plate also pass through an 8-shaped hole in a positioner so that the bended plate can only rotate in a certain definite angle. The positioner has two projections sticking in two position slots in the outer actuating tube and the bended plate has two bended semi-round walls, between which a projecting wall of a returning ring can fit. When the bended plate is rotated for 90°, the bended semi-round walls can climb up to the highest point of the projecting wall. The returning ring also has two ears fitting in and possible to move along two position slots in the outer actuating tube and two long feet extending rearward into two curved grooves in the actuating ring and extensible out of the curved grooves into notches of a moving ring. The actuating ring has (1) two opposite projections to fit in two straight slots of the outer actuating tube and (2) a square hole at its center for a rectangular section of a moving rod to fit therein. A spring is placed between the actuating ring and the returning ring. The moving ring can rotate idly inside the outer actuating tube and has (1) two notches for the two feet of the returning ring to extend therein and (2) a square hole at its center for the square shaft to pass through. The outer actuating tube is also assembled with a returning plate to return the outside knob to its original position after it is rotated. A base plate has (1) holes for bolts to pass through for combining with the outside cover screwing in its shaft posts and (2) threaded holes for bolts to screw therein for combining with an inside cover. Both the base plate and the inside cover have respectively a hole for an inside knob to fit and rotate therein. The inside knob contains and moves together with an inner actuating tube, having a shaft hole for a turning button to fit and rotate therein. The turning button has a cone-shaped ridge to engage with a cone-shaped groove or a shallow groove of a disc. The disc and a gasket have ears to fit in slots in the inner actuating tube so that they can move in a linear motion. 90° Rotation of the turning button can make the cone-shaped ridge engage in the cone-shaped groove or the shallow groove of the disc, which then is pushed to move straight. The inner actuating tube has its one end combined with the inside knob and contains the disc, an electro-magnetic coil, a position plate, a clutch disc, a coordinating ring, a square shaft, a moving rod, and a turning disc. The coordinating ring has (1) ears fitting in slots in the inner actuating tube and (2) a square hole for the square shaft to fit in. The square shaft passes through the dead bolt and has its interior for the moving rod to pass through and rotate idly therein. The moving rod has (1) a rectangular section at one end to fit in a square hole of the actuating ring and (2) an oval neck at the other end for C-shaped rings to retain the turning disc and the position plate on. The position plate has projections to fit in narrow slots in the inner actuating tube such that the moving rod may rotate at its position inside the inner actuating tube. The turning disc and the clutch disc can engage with each other to move all together o separate from each other. The clutch disc has its center riveted with the core of the electro-magnetic coil. The core is movable, having a recover spring set around it. When the core is moved by the powered electro-magnetic coil, it can cause the clutch disc to engage with the turning disc. But the core is pushed back by the recover spring when the power to the coil is cut off, and thereby the clutch disc is separated from the turning disc. The other end of the core is in contact with the disc when the coil is not powered.

The electronic lock equipped with the structure in the present invention can be locked from the inside of a door by rotating the turning button from its ordinary unlocked position for 90°, and can be unlocked at the outside of the door by using either a correct coded number card or a correct key after it is locked.

DETAILED DESCRIPTION OF THE INVENTION

Figure 1:
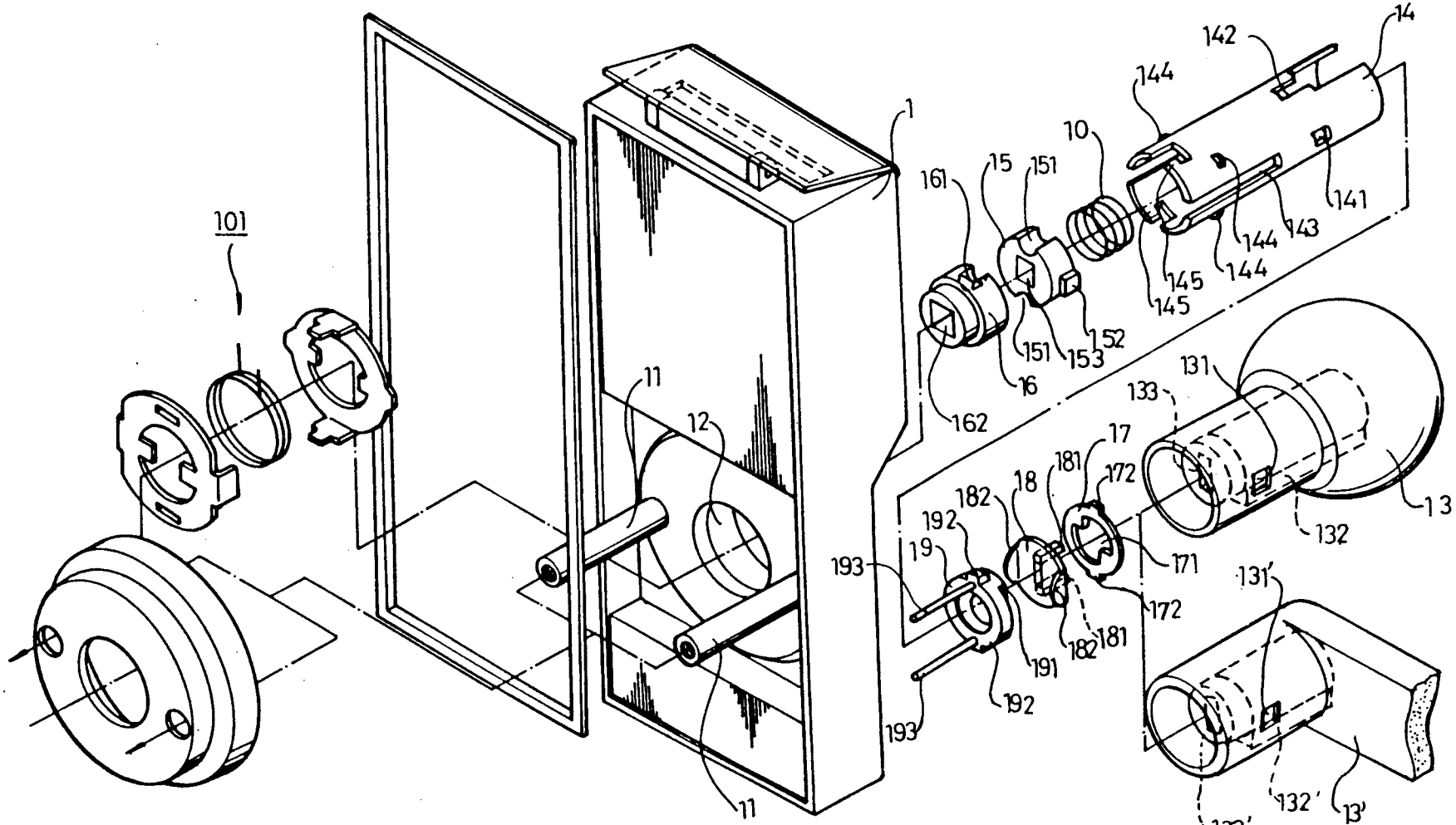
FIG. 1 is an exploded perspective view of the outside section of the structure for controlling the dead bolt used in an electronic lock in the present invention.

As FIG. 1 shows, the outside section of the structure for controlling the dead bolt used in an electronic lock in the present invention comprises outside cover 1 fixed at the outside surface of a door for containing a decoding circuit in an electronic lock, but the decoding circuit will not be described here, not included in this invention. Outside cover 1 has shaft hole 12 for outer actuating tube 14 to fit and turn therein. Outer actuating tube 14 is combined with outside knob or lever 13 or 13' having a recess 131 or 131' to engage with hole 141 in said tube 14 so that outside knob 13 can rotate said tube 14. In outside knob 13 is fixed key hole block holder 132

(or 132') for containing a key hole block to be turned by a correct key. The key hole block has a rectangular groove 133 (or 133') at its bottom face for two feet 181 of bended plate 18 to stick therein so that bended plate 18 can be rotated by the key hole block.

Bended plate 18 has two feet 181 passing through 8-shaped hole 171 in positioner 17 to restrict its own rotation within 90°. Positioner 217 has two opposite projections 172 sticking in position slots 142 in outer actuating tube 14 to prevent key hole block holder 132 from falling off. Bended plate 19 also has two opposite bended semi-round walls 182, between which projecting wall 191 of returning ring 19 extends. Said walls 182 can climb up to the highest point of the projecting wall 191 to press returning ring 19 when bended plate 18 is rotated. Returning ring 19 has two ears sticking in position slots 142 in said tube 14 so that returning ring 19 can only move in a liner motion, not rotate relative to said tube 14. Returning ring 19 has also two long feet extending axially to fit normally in curved grooves 151 of actuating ring 15 and extensible into notches 161 in moving ring 16 when said ring 19 is moved by bended plate 18.

Figure 2:
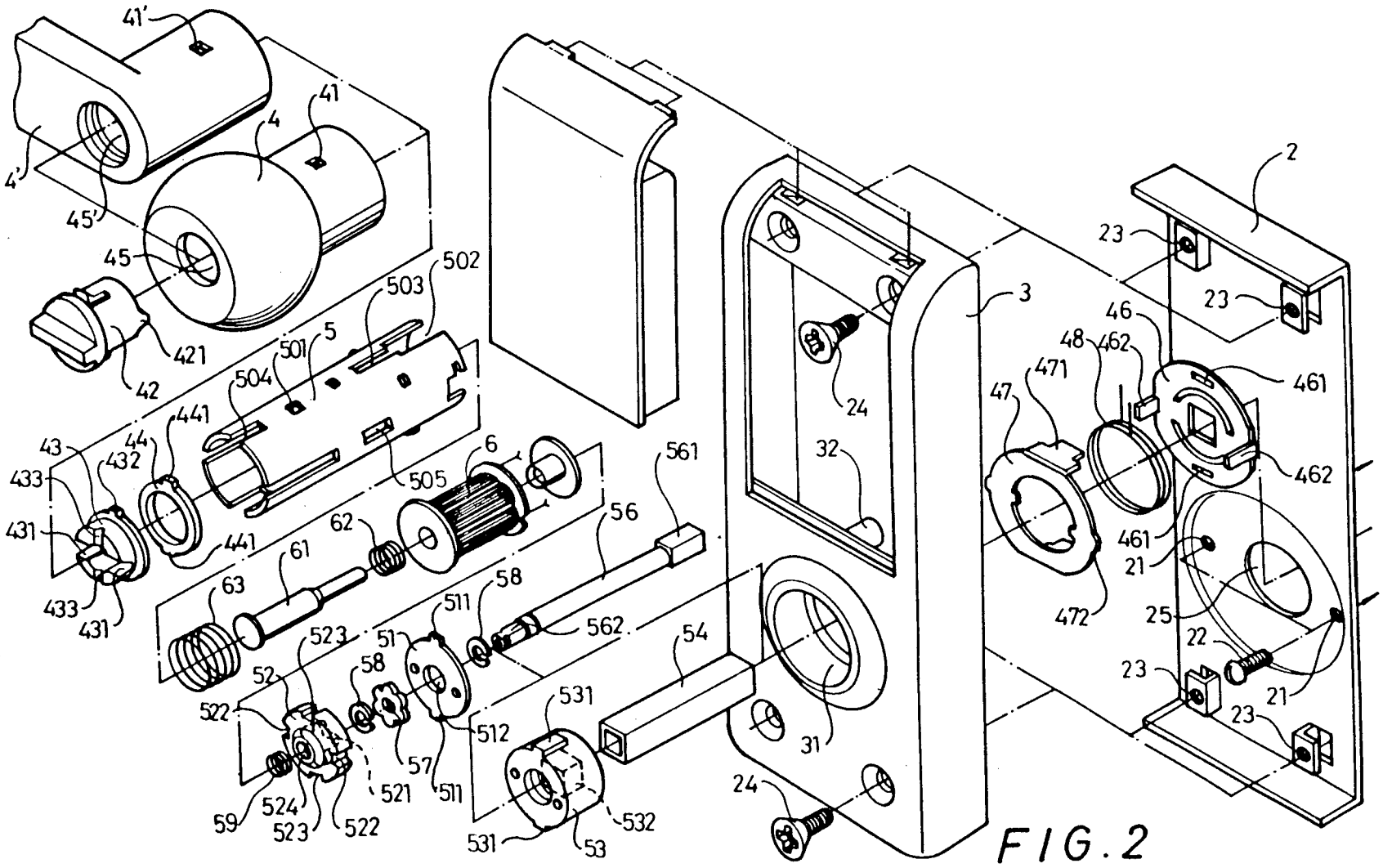
FIG. 2 is an exploded perspective view of the inside section of the structure for controlling the dead bolt used in an electronic lock in the present invention.
Figure 3:
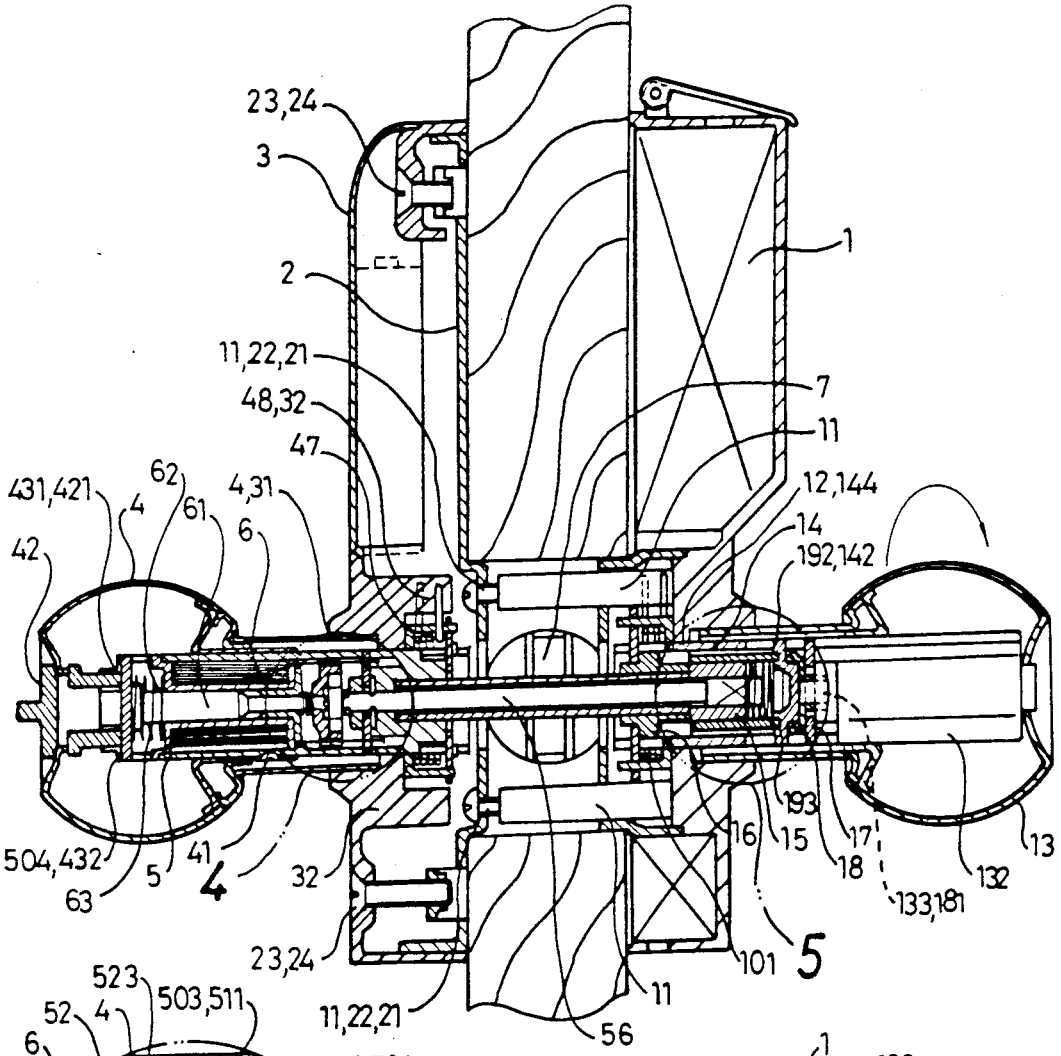
FIG. 3 is a cross-sectional view of the structure for controlling the dead bolt used in an electronic lock in the present invention.

Actuating ring 15 has two opposite ears 152 sticking in two opposite straight slots 143 in said tube 14, which contains in its interior a spring 10 urging actuating ring 15 with its one end and returning ring 19 with its other end. Actuating ring 15 also has square hole 153 at its center for engaging with square section 561 of moving rod 56 as shown in FIG. 2. Moving ring 16 can fit in outer actuating tube 14 without any mutual movement, provided with two notches 161 for two feet 193 of returning ring 19 to extend in or retreat out. When two feet 193 is extending in said notches 161, moving ring 16 can move together with said tube 14, but cannot move together when said feet 193 is retreating out of said notches 161. Moving ring 16 also has square hole 162 at its center for square shaft 54 to pass through as shown in FIG. 2, and shaft 54 passes through the dead bolt as shown in FIG. 3, and consequently moving ring 16 can cause the dead bolt to be retracted inward when it is rotated.

Outer actuating tube 14 is combined with positioner 17, bended plate 18 and moving ring 19 by means of its position slots 142, and with spring 10, actuating ring 15 and moving ring 16 by means of its straight slots 143. Outer actuating ring 14 also has four humps 144 on its outer peripheral surface to fit on the inner peripheral surface of shaft hole 12 in outer cover 1 when said ring 14 is combined with outer cover 1 so that said tube 14 can rotate therein stabilized. In addition, said tube 14 has a hole 141 for recess 131 (or 131') of outside knob or lever 13 or 13' to engage with, and can combine with returning plate 101 at its inside end after it is combined with outside cover 1. Returning plate 101 has the same structure as a conventional door lock has, and is to be combined with said tube 14 by means of tips 145 of said tube 14 bended to retain said plate 101, and thereby said tube 14 can be automatically returned to its original position when the actional force on said tube 14 disappears after it has been rotated.

Now FIG. 2 shows the structure of the inside section of this invention. It comprises base plate 2 and inside cover 3. Base plate 2 has holes 21 for bolts 22 to pass through to screw with shaft posts 11 of outside cover 1 and screw holes 23 for bolts 24 to combine with inside cover 3. Inside cover 3 and base plate 2 have respectively corresponding shaft holes 31 and 25 for inside knob or lever 4 or 4' to fit and rotate therein.

Inside knob or lever 4 or 4' has (1) recess 41 or 41' to stick in recess 501 in inner actuating tube 5 to enable the both to move together, and (2) shaft hole 45 or 45' for turning button 42 to fit and rotate therein. Turning button 42 has at its front cone-shaped ridge 421 to engage with cone-shaped groove 431 in disc 43. Projecting ears 432 and 441 disc 43 and gasket 44 have stick in two slots 504 in inner actuating tube 5 so that disc 43 can be moved lengthwise along slots 504 by mutual combination of cone-shaped ridge 421 and cone-shaped groove 431 when turning button 42 is rotated.

Figure 4:
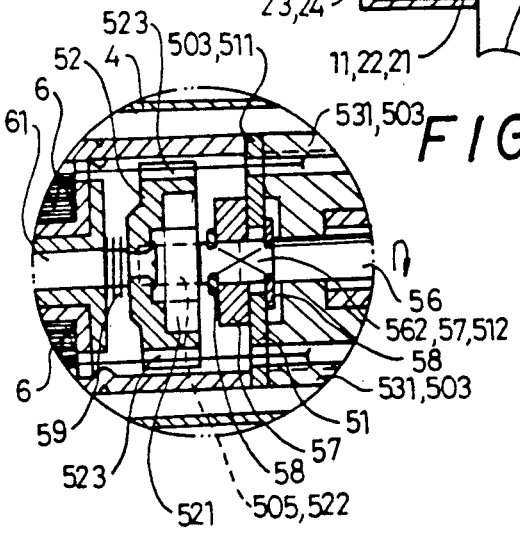
FIG. 4 is a magnified view of the part marked 4 on FIG. 3.

Inner actuating tube 5 has two opposite slots 502 for ears 531 of coordinating ring 53 to fit therein. Coordinating ring 53 is fixed inside inner actuating tube 5 to be moved thereby, provided with square shaft hole 532 in its center for square shaft 54 to fit therein, and shaft 54 is also assembled with the dead bolt as shown in FIG. 3, possible to retract the dead bolt to unlock when rotated and to contain moving rod 56 in its interior so that said rod 56 can rotate idly therein without mutual movement. Moving rod 56 has a longer length than shaft 54, and a rectangular section 561 extending out of shaft 54 and fitting in square hole 153 of actuating ring 15, which can rotate moving rod 56 inside shaft 54 when rotated. Moving rod 56 also has an oval section 562 at the other end to combines securely with petal-shaped turning disc 57 fixed between two C-shaped rings 58. To hold stabilized moving rod 56 position plate 51 is set between said two C-shaped rings 58 as shown in FIG. 4. Position plate 51 has opposite top and bottom projections 511 to stick in narrow slots 503 communicating with slots 502 such that moving rod 56 can only turn idly in hole 512 in position plate 51, but cannot move axially.

Turning disc 57 is shaped like flower petals and can be moved to engage with clutch opening 521 of clutch disc 52, which cannot rotate inner actuating tube 5, but can rotate together with said tube 5, having grooves 522 fitted in by recess 505 of said tube 5 as to move in a straight line so that clutch disc 52 can engage with or separate from turning disc 57. Clutch disc 52 also has two opposite grooves 523 for electric wires to pass through, and a central hole 524, through which a rivet passes to rivet clutch disc 52 with core 61 of electro-magnetic coil 6 fixed firmly inside inner actuating tube 5. When electro-magnetic coil 6 is powered, core 61 can be moved by the magnetism produced so that clutch disc 52 can be moved near turning disc 57 for mutual engagement. But when electro-magnetic coil 6 is not powered, core 61 is pushed back to its original position by spring 62 so that clutch disc 52 is separated from turning disc 57.

Core 61 has its other end kept in constant contact with disc 43, so disc 43 can press to move core 61 forward as cone-shaped ridge 421 of turning button 42 can be made to climb up to shallow groove 433 of disc 43 when turning button 42 is rotated. Thereby, clutch disc 52 pushed by core 61 becomes engaged with turning disc 57. But if turning button 42 is rotated again, letting cone-shaped ridge 421 stick in cone-letting shaped grooves 431, disc 43 is then pushed by spring 63 to engage with turning button 42 and core 61 is also pushed back by spring 62, permitting clutch disc 52 separate from turning disc 57.

Returning plate 46 is set inside inner actuating tube 5 to return inside knob or lever 4 or 4' to its ordinary position after its rotation, having (1) two opposite slots 461 for feet 471 of limiting plate 47 to insert therein and (2) two opposite feet 462 to push the surface of limiting plate 47 so that returning plate 46 and limiting plate 47 can move each other and be kept in a definite distance as well. And spring 48 is placed between the both 46 and 47, having its one end stuck at foot 32 of inside cover 3 and the other end at one of feet 471 of limiting plate 47 having two opposite projections 472. When inside knob or lever 4 or 4' is rotated, one end of spring 48 can be pressed, and then if inside knob 4 is released, it can be pushed back by spring 48 to its ordinary position. This structure is a well-known art.

FIG. 3 shows the electronic lock in this invention is locked. In this position, turning button 42 has been turned for 90° from its ordinary (unlocked) position, cone-shaped ridge 421 sticking in cone-shaped groove 431 and clutch disc 52 disengaged with and separated from turning disc 57 as shown in FIG. 4. Then, how outside and inside knob and the coded card and the key work under this locked condition is to be described as follows.

Figure 5:
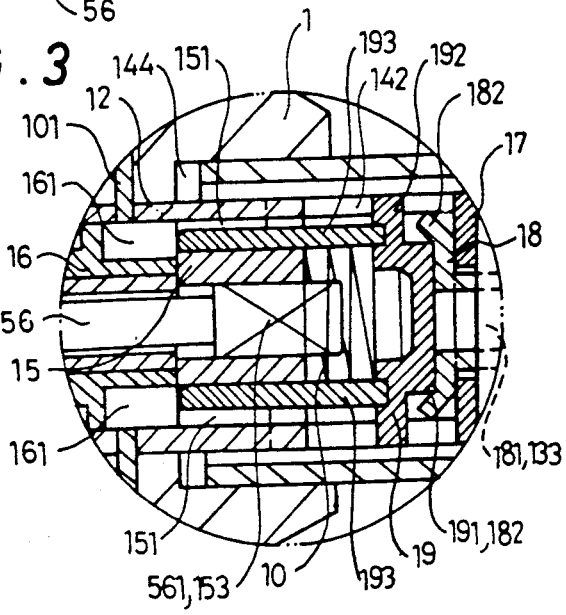
FIG. 5 is a magnified view of the part marked 5 on FIG. 3.

(1) If outside knob 13 is rotated, it can rotate outer actuating tube 14, and then actuating ring 15, but moving ring 16 cannot be rotated, because long feet 193 of returning ring 19 is separated from notches 161 of moving ring 16 as shown in FIG. 5. Therefore, although actuating ring 15 can rotate moving rod 16, turning disc 57 is disengaged with clutch disc 52 so that outside knob 13 only turns idly, impossible to retract the dead bolt to unlock this lock.

(2) If inside knob 4 is rotated, it can rotate inner actuating tube 5, and then square shaft 54 via coordinating ring 53. So the dead bolt assembled with shaft 54 can be retracted, and that is, this lock is opened by rotation of inside knob 4.

Figure 7:
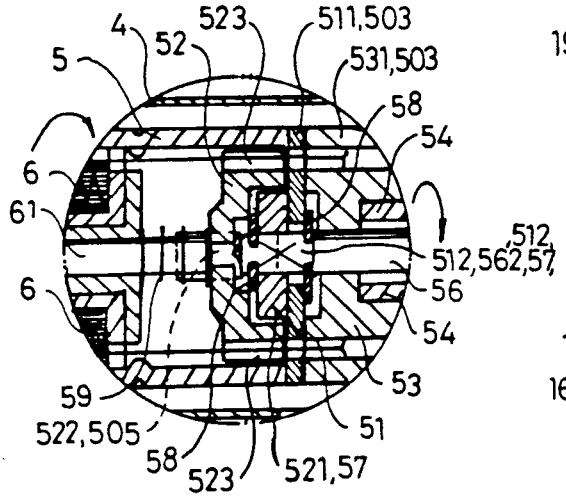
FIG. 7 is a magnified view of the part marked 7 on FIG. 6.

(3) If a correct coded number card is inserted in outside cover 1, electro-magnetic coil 6 can be powered for a pre-set period of time, which is a known art. Then, said coil 6 produces magnetism to pull core 61, letting clutch disc 52 engage with turning disc 57 as shown in FIG. 7. In this position, rotation of outside knob 13 can cause inner actuating tube 5 to rotate via clutch disc 52, and said tube 5 can make square shaft 54 to rotate via coordination ring 53, and the dead bolt can finally be retracted by rotation of square shaft 54. But after the power to electro-magnetic coil 6 is cut off, outside knob 13 can only turn idly, impossible to open the lock, as clutch disc 52 is already separated from turning disc 57.

Figure 8:
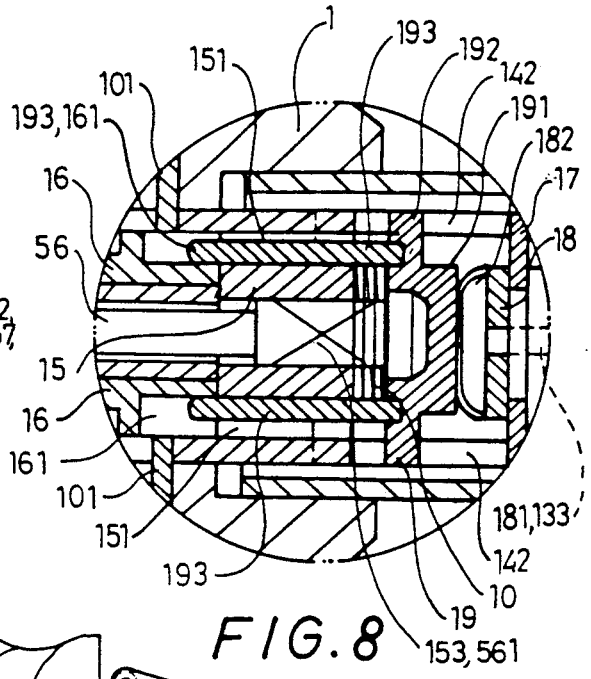
FIG. 8 is a magnified view of the part marked 8 on FIG. 6.
Figure 6:
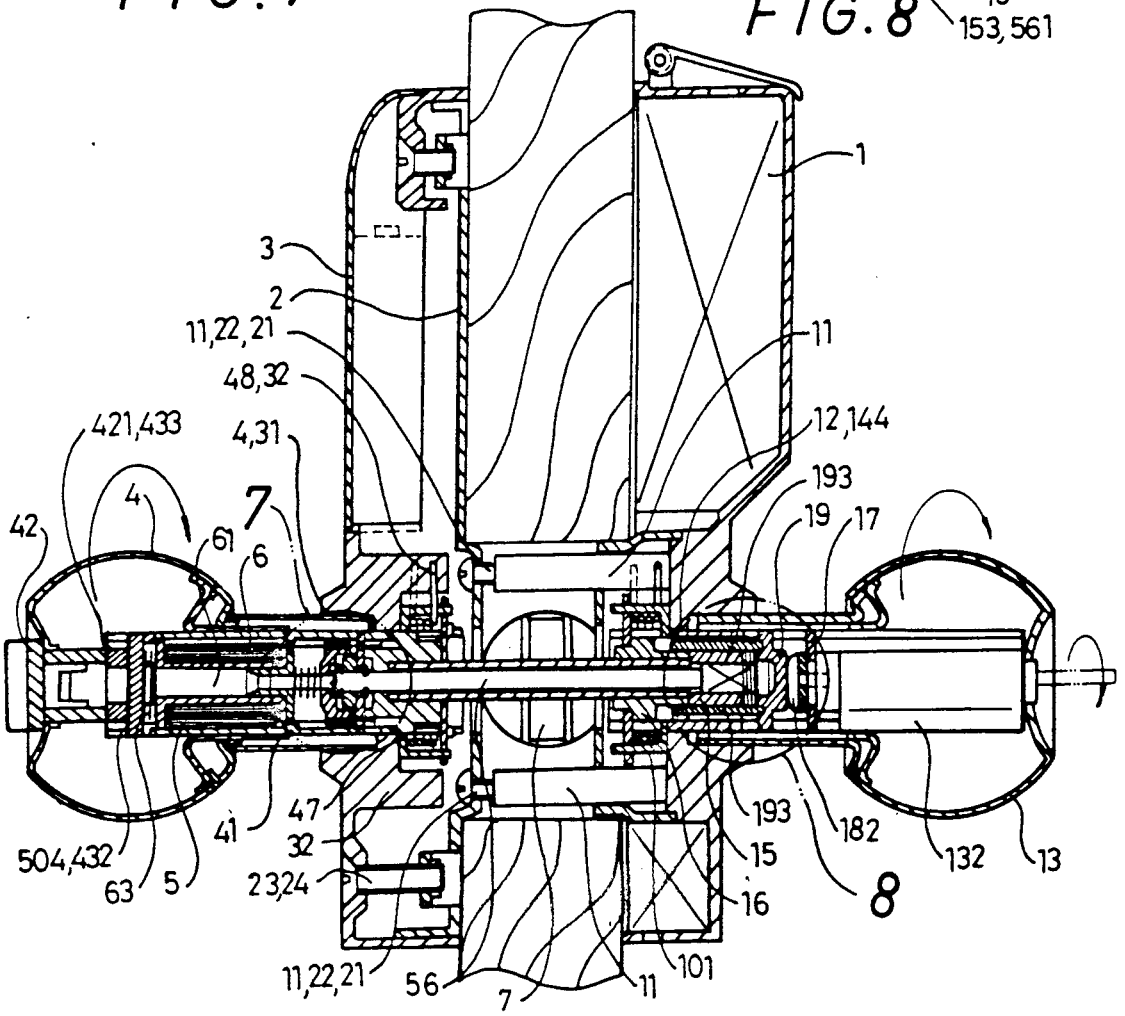
FIG. 6 is a cross-sectional view of the structure for controlling the dead bolt used in an electronic lock in the present invention.

(4) If a correct key is inserted in the key hole block of outside knob 13 and turned to rotate the key hole block for 90°, the key hole block can rotate bended plate 18 for 90° as shown in FIGS. 6 and 8, bended walls 182 climbing up to the highest point of projecting wall 191, returning ring 19 coming nearer actuating ring 15, and two feet 193 extending deep in notches 161 so that turning of outside knob 13 can retract the dead bolt by inter-related movement of outer actuating tube 14, returning ring 19, moving ring 16, and square shaft 54, opening the lock.

When turning button 42 is not turned for 90°, kept in its original position to maintain this lock in unlocked position, as shown in FIG. 6.

(5) 90° rotation of either inside or outside knob 4 or 13 can retract the dead bolt, as the cone-shaped ridge 421 of turning button 42 has its bottom engaging with shallow groove 433 so that disc 43 presses core 61 and clutch disc 52 engages with turning disc 57 as shown in FIG. 7.

In general, the structure in this invention is to make use of the 90° rotation of turning button 42 equipped in inside knob 4 in locking this lock, which can be unlocked with a correct coded number card or a correct key. Then, this electronic lock equipped with this structure can have a wider adaptability than conventional ones.

What is claimed is:

1. A kind of structure for controlling the dead bolt used in an electronic lock comprising;

an outside cover to be anchored on the outside surface of a door by means of two shaft posts, said cover having a shaft hole for an outer actuating tube to fit and rotate therein, said outer actuating tube being assembled with an outside knob or lever for mutual movement, said outside knob having a key hole block holder retaining a key hole block possible to be turned with a key inserting in the key hole, said key hole block having a rectangular hole at its bottom end for two feet of a bended plate to fit in so that the bended plate can be rotated by the key hole block, said bended plate having its feet also passing through an 8-shaped hole in a positioner so that the bended plate can only rotate therein within a certain definite angle, said positioner having two projections sticking in two position slots of the outer actuating tube, said bended plate also having two opposite bended semi-round walls between which a projection wall of a returning ring can fit, said bended semi-round walls being possible to climb up to the highest point of said projecting wall when the bended plate is rotated for 90°, said returning ring having two opposite ears sticking in position slots of the outer actuating tube so that said returning ring can move in a linear motion along the portion slots, said returning ring also having two long feet passing through curved grooves in an actuating ring and extending in two notches of a moving ring, said actuating ring having two opposite projections fitting in two straight slots in the outer actuating tube, a spring being placed between the actuating ring and the returning ring, said actuating ring having a square hole as its center for a square section of a moving rod to fit in, said moving ring being possible to rotate idly inside the outer actuating tube and having (1) two notches for the two long feet of the returning ring to extend therein and (2) a square hole for the square shaft to pass through, and a returning plate being assembled with the outer actuating tube to return the outside knob to its original position after said knob is rotated;

a base plate having (1) tow holes for bolts to pass through to screw the base plate with the shaft posts of the outside cover and (2) threaded holes for bolts to assemble the base plate with an inside cover, said base plate and inside cover respectively having a shaft hole for an inside knob to fit and rotate therein;

an inside knob being assembled with an inner actuating tube for mutual movement and having a shaft hole for a turning button to fit and rotate therein, said turning button having a cone-shaped ridge projecting from the inner end to engage with either a cone-shaped groove or a shallow groove of a disc, said disc and a gasket respectively having two ears to fit in and move along slots in an inner actuating tube so that said disc and gasket can move in a linear motion, said turning button being possible to be turned for 90° letting its cone-shaped ridge engage in either the cone-shaped groove or the shallow groove so as to force the disc to move in a linear motion;

an inner actuating tube having one of its end assembled with the inside knob and containing a disc, an electro-magnetic coil, a position plate, a clutch disc, a coordinating ring, a square shaft, a moving rod and a turning disc in its interior, said coordinating ring having (1) two opposite ears to fit in opposite slots in the inner actuating tube and (2) a square shaft hole for the square shaft passing through the dead bolt to engage in, said square shaft having its empty interior for the moving rod to pass through and to rotate idly therein, said moving rod having (1) one end having a rectangular section to fit in the square hole of the actuating ring and (2) the other end shaped oval for two C-shaped rings to fit in to retain the turning disc and the position plate thereat, said position plate having two opposite projections fitting in two narrow slots of the inner actuating tube so that the moving rod can rotate at its stabilized position inside said tube, said turning disc being possible to engage with the clutch disc to move together, said clutch disc having its center riveted with the core of the electro-magnetic coil for mutual movement;

an electro-magnetic coil having (1) its core movable to and fro, and (2) one end riveted with the clutch disc, said core having a spring around it and being possible to be moved by magnetism produced by said coil when said coil is powered so that the clutch disc may be moved to engage with the turning disc, while the clutch disc urging the disc separates from the turning disc when said coil is not powered because the core can be pushed by a spring.

2. The structure for controlling the dead bolt used in an electronic lock as claimed in claim 1, wherein the outer actuating tube has humps on its outer peripheral surface to stick on the inner peripheral surface of the shaft hole in the outer cover so that said tube can be rotated at its position by the rotation of the outside knob.

3. The structure for controlling the dead bolt used in an electronic lock as claimed in claim 1, wherein the outer actuating tube contains in its interior an actuating ring having two opposite projections fitting in two opposite straight slots in said tube so that rotation of said tube can force the actuating ring to rotate together.

4. The structure for controlling the dead bolt used in an electronic lock as claimed in claim 1, wherein the actuating ring contained in the outer actuating tube can move together with the moving rod contained in the inner actuating tube.

5. The structure for controlling the dead bolt used in an electronic lock as claimed in claim 1, wherein the outer actuating tube can contain in its interior a moving ring, which can turn around idly therein.

6. The structure for controlling the dead bolt used in an electronic lock as claimed in claim 1, wherein the moving ring can be assembled with the square shaft passing through the dead bolt such that rotation of the moving ring can turn the square shaft to retract the dead bolt.

7. The structure for controlling the dead bolt used in an electronic lock as claimed in claim 1, wherein the moving ring has two notches for the two feet of the returning ring to extend therein such that the returning ring can rotate the moving ring.

8. The structure for controlling the dead bolt used in an electronic lock as claimed in claim 1, wherein the inner actuating tube has two narrow slots for the two ears of the coordinating ring to fit in such that rotation of the inner actuating tube can force the coordinating ring to rotate together.

9. The structure for controlling the dead bolt used in an electronic lock as claimed in claim 1, wherein a spring is placed between the actuating ring and the returning ring, urging the two feet of the returning ring to lie in the curved grooves of the actuating ring.

10. The structure for controlling the dead bolt used in an electronic lock as claimed in claim 1, wherein the returning ring has a projecting wall either possible to fit between two opposite bended semi-round walls of the bended plate or possible to permit the bended walls of the bended plate climb up to its highest point such that the returning ring moves straight along the straight slots in the inner actuating tube, the feet of the returning ring extending out of the curved grooves of the actuating ring into the notches of the moving ring when the bended plate is rotated.

11. The structure for controlling the dead bolt used in an electronic lock as claimed in claim 1, wherein the bended plate has two projecting feet to fit in the key hole in the key hole block such that rotation of the key hole block can cause the berded plate to rotate together.

12. The structure for controlling the dead bolt used in an electronic lock as claimed in claim 1, wherein the outer actuating tube can be assembled at its outer surface with a returning plate such that the outside knob and the outer actuating tube can automatically return to their original position when the force turning them disappears.

13. The structure for controlling the dead bolt used in an electronic lock as claimed in claim 1, wherein the moving rod has one end possible to engage and move together with the actuating ring and the other end assembled with a turning disc either engaging with or separating from the clutch disc.

* * * * *